United States Patent [19]

Kuechler

[11] 3,943,836

[45] Mar. 16, 1976

[54] APPARATUS FOR REMOVING FUMES FROM THE SPACE ABOVE A COOKING APPLIANCE IN A RESTAURANT

[75] Inventor: Irvin R. Kuechler, San Bernardino, Calif.

[73] Assignee: Vent-Cair, Inc., San Bernardino, Calif.

[22] Filed: Aug. 15, 1974

[21] Appl. No.: 497,690

[52] U.S. Cl. ..... 98/115 K; 55/439; 55/467; 55/DIG. 36; 98/36; 126/299 B

[51] Int. Cl.[2] ..... F23J 11/02

[58] Field of Search ..... 55/DIG. 36, 439, 440, 467; 98/36, 115 K; 126/299 R, 299 A, 299 B

[56] References Cited

UNITED STATES PATENTS

| | | | |
|---|---|---|---|
| 2,868,108 | 1/1959 | Peterson | 98/115 K |
| 3,021,777 | 2/1962 | Smith | 98/115 K |
| 3,207,058 | 9/1965 | Gaylord | 98/115 K |
| 3,664,255 | 5/1972 | Kuechler | 98/115 K |
| 3,841,062 | 10/1974 | Molitor et al. | 98/115 K |

*Primary Examiner*—William F. O'Dea
*Assistant Examiner*—Ronald C. Capossela
*Attorney, Agent, or Firm*—Richard L. Gausewitz

[57] ABSTRACT

A vortex-type smoke hood, in which the liner of the hood is substantially continuously curved in such manner that the vortex action is improved greatly. One result is that the supply air velocity may be increased by a major amount, without causing "bouncing" of air and fumes out of the hood. The curved wall produces the additional benefit of rendering more smooth the flow path of the inlet air.

In a second embodiment, a plate shelf and/or pass-through are combined with the hood, creating a very convenient relationship and one whereby the cook remains highly comfortable.

37 Claims, 6 Drawing Figures

APPARATUS FOR REMOVING FUMES FROM THE SPACE ABOVE A COOKING APPLIANCE IN A RESTAURANT

BACKGROUND OF THE INVENTION

1. Field of the Invention

This invention relates to the field of smoke hoods for removing grease and smoke from the spaces above cooking appliances, particularly in restaurants.

2. Description of Prior Art

The original patent in the field of vortex-type smoke hoods for cooking appliances is U.S. Pat. No. 3,664,255, issued May 23, 1972. Although the invention of such patent is believed to be a major one, the specific apparatus shown and described therein did not permit achievement of the fullest benefits of the large upper vortex. Stated more specifically, the velocity of the supply air in the apparatus of such patent could be increased only to a limited extent. Further increases resulted in "bouncing" or "rebounding" of supply air and of entrained fumes down out of the hood and into the room.

A relatively high velocity of supply air to the vortex, especially the upper vortex, is important for a number of reasons. The vortex principle causes a first centrifugal separation of grease to occur in the capture chamber, before the air and fumes pass through the filter. An analogy to the centrifugal grease separation in the upper vortex would be a jet traveling at high speed toward a cliff to bomb a target on the side thereof. As the jet (analogous to the air) pulls up, the bomb (analogous to a grease particle) is released — so that the forward "bomb" (grease) velocity sends it at high speed into the cliff (analogous to the filter). The grease after impinging against the filter clings thereto instead of passing up the chimney. A second centrifugal grease separation action then occurs in the filter itself, as stated below.

The faster the air flow in the vortex (especially the upper vortex) in the capture chamber, the more effective the stated centrifugal grease-separation action therein.

Additional important reasons for creating a high-velocity upper vortex include a substantial simplification in the method by which the apparatus is set up for use. As explained in the above-cited patent, by far the greatest part of the air which passes out through the filters is not supplied from the room (the kitchen) but instead comes directly from the outside of the room. For example, in a typical installation only about 10% of the air comes from the room whereas 90% of the air comes from the outside. In attempting to achieve the desired balance between air supply to the hood, and air exhaust therefrom, it is important that the operator not be hampered by inability to increase the volume of the air supply sufficiently by increasing its velocity. As stated above, the operator would be so hampered if the otherwise-desired intake air velocity were so great as to cause rebound of air and smoke into the room.

The present apparatus achieves very effective separation of grease from the cooking fumes, yet permits a relatively simple set-up procedure. Furthermore, it is capable of withstanding substantial variations in the speeds of the supply and exhaust blowers (that is, speeds of the supply and exhaust air) without malfunctioning to a substantial degree.

Relative to a different aspect of the present disclosure, there have long existed restaurants which have plate shelves and/or pass-throughs beneath the smoke hoods. However, such restaurants did not achieve anything approximating the economy, efficiency, etc., of the shelf-smoke hood combination disclosed herein. In particular, there were no (insofar as applicant is aware) forced-flow smoke hoods which were so constructed that only a natural convective flow of air and cooking fumes passed upwardly adjacent the pass-through and/or the plate shelf.

In the above-cited patent, the baffle plate or member 54 was adjustable as described therein. The baffle 18 of the present disclosure is preferably (for economy reasons) fixed instead of adjustable. Such fixed baffle 18, the lip 19 at the rear edge thereof, and the central support 22 therefor, have all been on the market more than one year prior to the filing date of the present application and thus constitute prior art.

Summary of the Invention

The present invention provides a substantially continuously curved wall at the upper portion of the capture chamber, the curve being such as to permit creation of a high-velocity upper vortex of air and cooking fumes. Furthermore, there is provided at the front portion of such curved wall a relatively wide liner extension, which extension aids greatly in preventing high-velocity upper vortex air and fumes from passing downwardly out of the hood. Instead, the vortex air and fumes are directed substantially parallel to and above the curtain of inflowing supply air. The results are surprising increases in vortex action, in ease of set-up and adjustment, and other factors.

The forward region of the curved wall defines, at the side thereof remote from the capture chamber wherein the vortex exists, a curved vertical throat region which aids in smoothly directing the down-flowing supply of inlet air.

In a second embodiment, there is provided above the forward region of the cooking appliance at least one wall or shelf, preferably a plate-storage shelf and/or a pass-through shelf. Air from the room drawn rearwardly over the upper portion of the stove or other cooking appliance, by the upwardly rising hot air therefrom, entrains cooking fumes. The hot air and fumes then convect upwardly, rearwardly of the stated wall or shelf, through the open bottom of the capture chamber. Thereafter, the air and fumes are entrained in the laminar curtain of inlet air and are directed toward the filters. Some of the air and fumes are whirled around in the upper and lower vortexes before flowing through the filters.

DESCRIPTION OF THE PREFERRED EMBODIMENT

Figure 1:
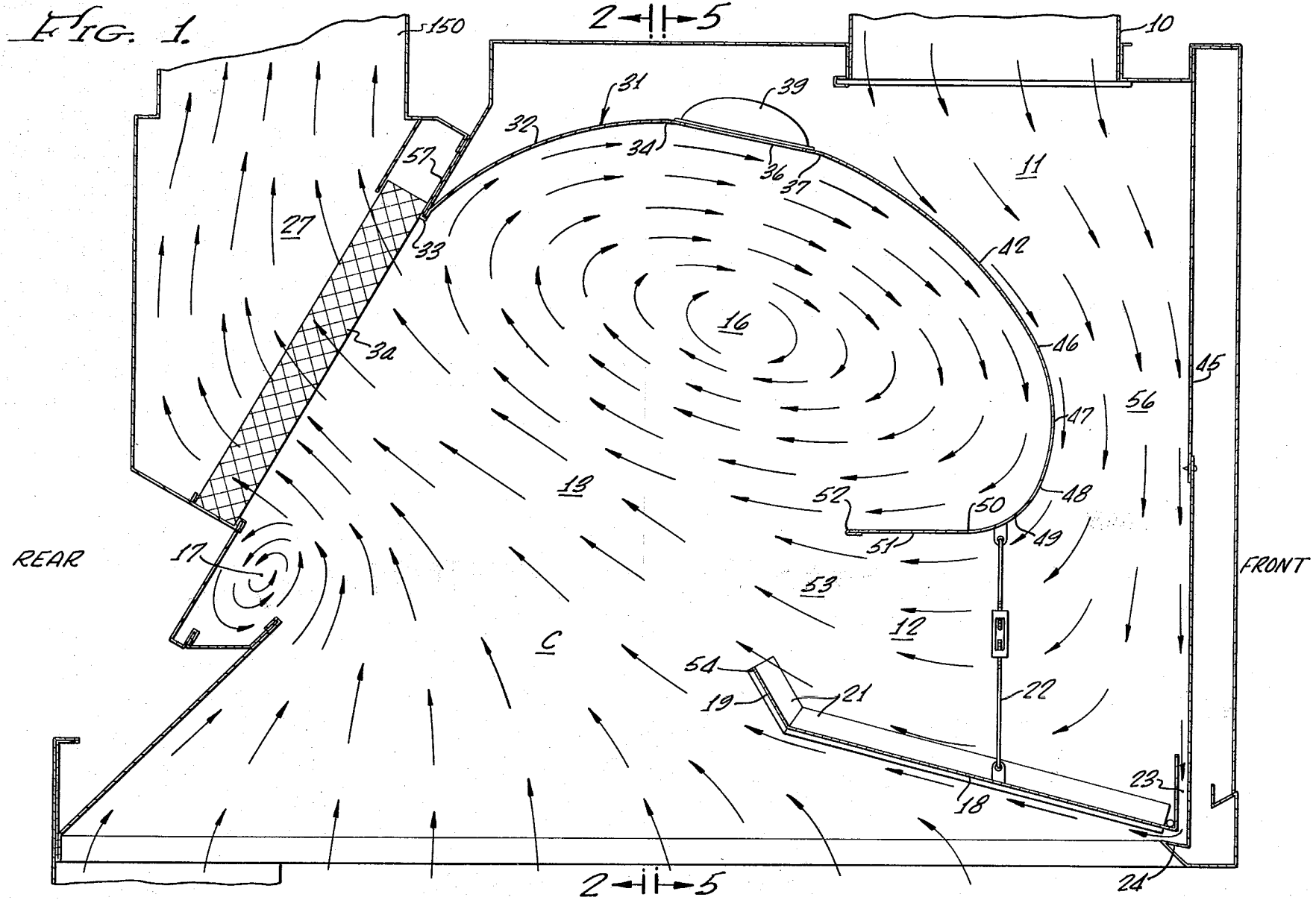
FIG. 1 is a vertical sectional view of the present smoke hood apparatus for removing fumes from the space above a cooking appliance, the ceiling of the room in which the smoke apparatus is disposed being unshown.

Except as specifically stated herein, the apparatus is substantially the same as that described and claimed in U.S. Pat. No. 3,664,225, issued May 23, 1972, for Apparatus and Method for Removing Fumes from the Space Above a Cooking Appliance. The disclosure of said patent is hereby incorporated by reference herein as though set forth in full.

As described in said U.S. Pat. No. 3,664,255, a supply blower is employed to draw air from a region exterior to the room in which the cooking appliance is disposed, and supplies such air (referred to as inlet air) downwardly through a duct means (the lower region of which is shown at 10 in the present patent application, FIGS. 1, 5 and 6) to a supply chamber (numbered 11 in the present patent application) and thence to a generally horizontal throat portion (numbered 12 in the present application) which may also be generally described as a director means.

From the throat portion 12, the incoming air flows in a stream or air curtain 13 which is inclined upwardly and rearwardly and which is generally perpendicular to filter means 3a. Some of the air in curtain 13 passes directly through the filter means *3a;* some of the air therein passes upwardly and forms part of a large-diameter upper vortex 16; and some of the air passes downwardly and forms part of a small-diameter lower vortex 17. Eventually, all of the inlet air from throat 12 (not only that which flows directly through the filter, but also that which recirculates for a period of time in the upper and lower vortexes 16 and 17) passes through the filter means *3a* and is exhausted to the exterior of the room as described below.

The housing of the present smoke hood apparatus comprises an open-bottomed capture and entrainment chamber "C" into which grease-containing fumes pass from the cooking appliance which is disposed beneath the smoke hood apparatus. In such capture and entrainment chamber C, the grease-containing fumes are entrained in the air curtain 13 and therefore are directed at high velocity toward the filter means *3a.* Furthermore, and particularly when the inlet air from the exterior of the room is relatively cool (although it is emphasized that the inlet air is almost always substantially cooler than the upflowing fumes) there is a substantial chilling action having a tendency to solidify the grease particles in the fumes. As the filter means 3a are approached, some of the air and fumes in air curtain 13 swerves upwardly into the upper vortex 16, whereas other of the air and fumes swerves downwardly into the lower vortex 17. However, despite such swerving of the air, the entrained heavy grease particles continue their forward motion and tend to impinge against the filter *3a,* the result being a centrifugal separation action which occurs in the capture and entrainment chamber C. The grease particles which impinge against the filter means 3a cling thereto and run down into trough means described in the cited U.S. Pat. No. 3,664,255.

Figure 3:
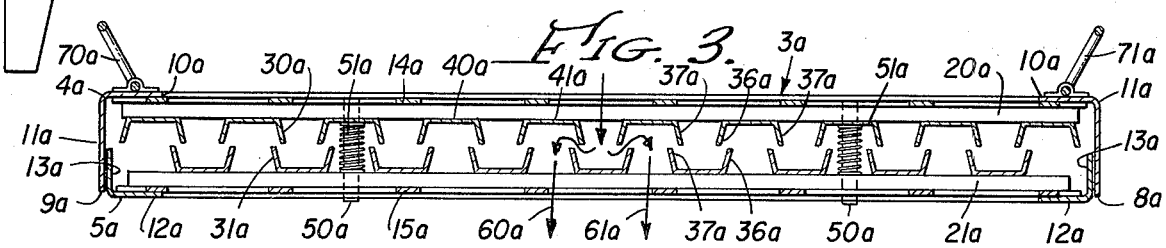
FIG. 3 is a horizontal sectional view on line 3—3 of FIG. 2, illustrating filter means.

The filter means *3a* is best shown in FIG. 3, and is described in U.S. Pat. No. 3,566,585, issued Mar. 2, 1971, for a Grease-Extracting Apparatus. The disclosure of said patent is hereby incorporated by reference herein as though set forth in full. Said filters are numbered *3a* in the present application, and are preferably operated in the open mode (FIG. 4 of said U.S. Pat. No. 3,566,585), not in the closed mode (FIG. 5 of said patent). The numbers shown in FIG. 3 of the present application correspond to the numbering in said U.S. Pat. No. 3,566,585, except that in each instance the suffix "*a*" has been appended to the elements in FIG. 3 of the present application.

In the filter means *3a,* a second centrifugal separation action occurs (in addition to the above described separation occurring by direct impingement), so that the degree of grease removal from the cooking fumes is very great. However, it is highly important that the flow of air and fumes through the filter means *3a* be substantially uniform throughout the entire width of the filter means. The achievement of such substantially uniformity is effected, without clogging up of screens, etc., by grease particles, as described in detail in my copending application Ser. No. 336,970, filed Mar. 1, 1973, for Apparatus and Method for Extracting Grease and Smoke, now abandoned. Said patent application is hereby incorporated by reference herein as though set forth in full. Such application describes an extended plenum 150 which communicates with the plenum chamber or exhaust chamber 27 on the downstream side of the filter means *3a.* Referring to FIG. 2 of the present application, the extended plenum 150 communicates with an exhaust blower 44 which discharges filtered air and fumes to the ambient space outside of the room wherein the cooking appliance is disposed.

The above-mentioned generally horizontal throat portion 12 is defined on the lower side thereof by an upwardly inclined baffle plate 18 having a further upwardly inclined lip 19 at the rear edge thereof. For reasons of economy of production, and maintenance of the precise desired angles, the baffle plate 18 and its lip 19 are preferably fixed in position, for example by angle bars 21 which are suitably secured to the side walls of the apparatus and are shown in FIGS. 1 and 5. To prevent sagging of the central region of the baffle plate 18, a connector element 22 (incorporating a turnbuckle) is connected between the central region of the baffle plate and the central region of the substantially continuously curved member (described below) thereabove.

As described in said U.S. Pat. No. 3,664,255, not all of the inlet air from the duct means 10 passes through the throat 12, since some passes downwardly through a gap 23 (FIG. 1) and then strikes a ledge means 24 disposed at the front portion of the apparatus. The ledge means 24 redirects the air rearwardly toward the capture and entrainment chamber C.

THE SUBSTANTIALLY CONTINUOUSLY CURVED VORTEX LINER

Figure 4:
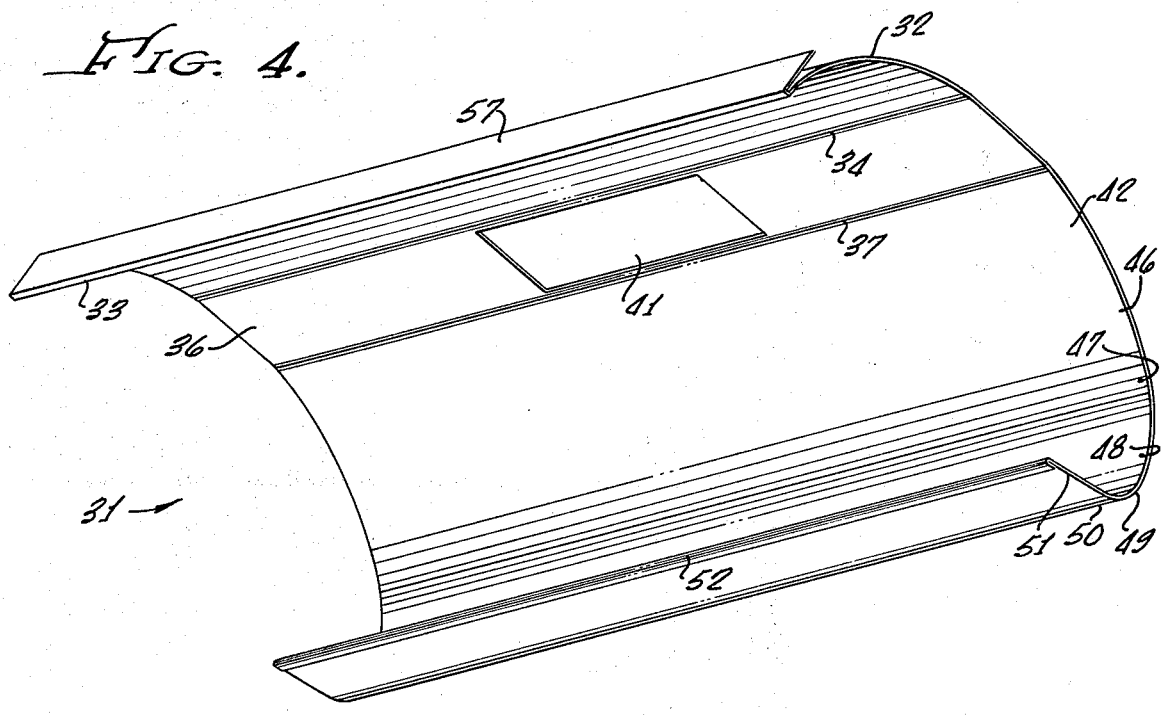
FIG. 4 is an isometric view illustrating the substantially curved liner of the capture chamber of the smoke hood.
Figure 5:
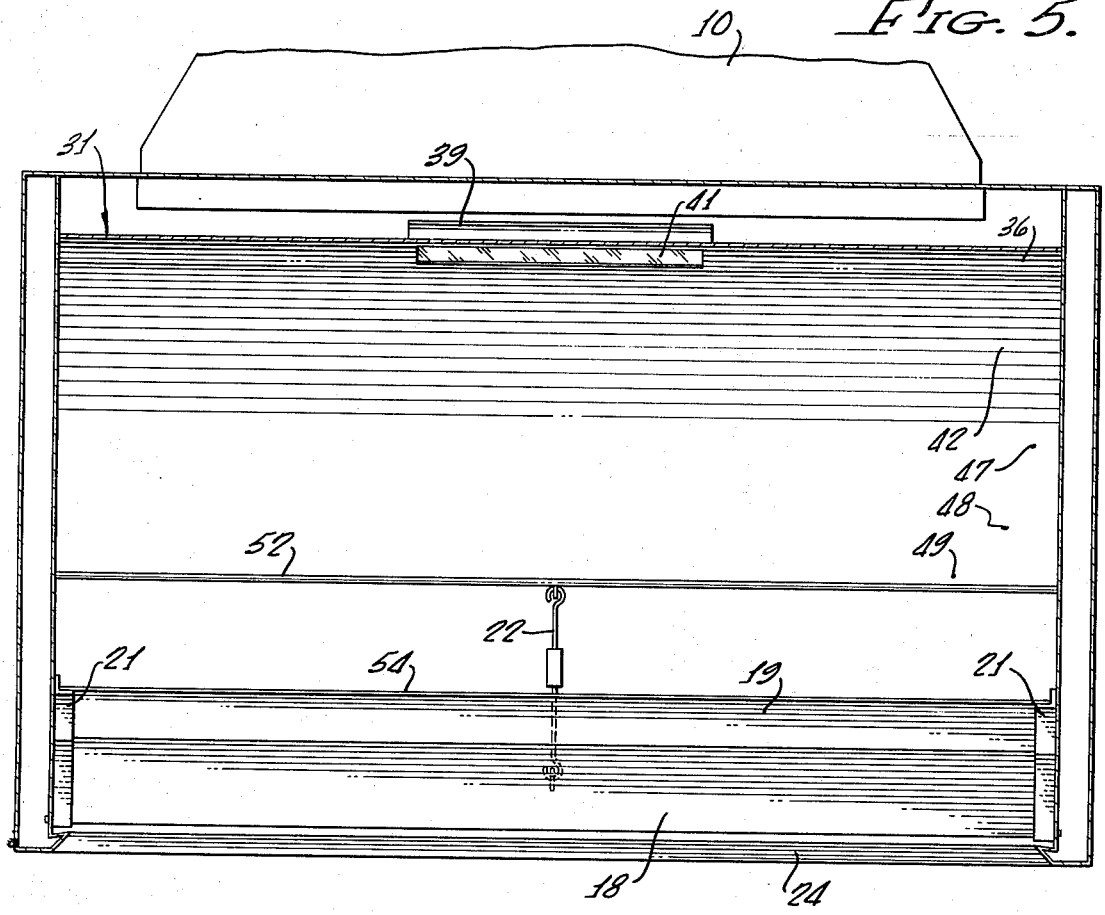
FIG. 5 is a vertical sectional view taken on line 5—5 of FIG. 1, and looking in a forward direction.

Referring particularly to FIGS. 1 and 4, the upper liner of the upper vortex portion of capture and entrainment chamber C is designated generally by the reference numeral 31, and may sometimes be referred to as the vortex liner. Such vortex liner has a rearwardmost first portion 32, the lower edge 33 of which is adjacent the upper face of filter means *3a.* From such lower edge 33, the first portion 32 curves upwardly and forwardly to a region 34 which is spaced above and substantially forwardly of the lower edge 33.

A relatively narrow, flat, downwardly-inclined second portion 36 extends from region 34 forwardly and downwardly to a region 37. The narrow second portion 36 is just wide enough to receive a light fixture 39, preferably florescent, which fixture is mounted thereabove and is registered with an opening 41 (FIG. 4) in the second portion.

From region 37, the vortex liner 31 curves downwardly and forwardly to form a curved third portion 42. The third portion 42 curves downwardly and forwardly with a relatively small amount of curvature, to a region 46 best shown in FIG. 1. From region 46, the vortex liner 31 curves downwardly and substantially vertically to form a forwardmost fourth portion 47, the lower edge of such fourth portion 47 being at a region 48. The vortex liner 31 then curves downwardly and rearwardly, with a relatively sharp curvature, to form a fifth portion 49 between regions 48 and 50. Thereafter, the vortex liner extends rearwardly and generally horizontally to form a sixth portion 51 (which may be termed a "linear extension") terminating in a rear edge 52.

The sixth portion 51 is substantially flat and substantially horizontal, this being in contrast with the upwardly and rearwardly inclined baffle plate 18 therebelow and in contrast with the much more upwardly and rearwardly inclined lip 19 on such baffle plate 18. It is emphasized that the sixth portion 51 extends rearwardly a very substantial distance from the generally vertical curved fourth portion 47 of the vortex liner 31. Stated otherwise, the two portions 49 and 51 of the vortex liner combine to form a relatively wide (front to back) section thereof, such wide section extending rearwardly from the generally vertical curved fourth portion 47.

This wide section (portions 49 and 51) of the vortex liner performs the function of insuring that the rapidly vortexing air and fumes in the upper vortex 16 are directed rearwardly generally toward the filter means 3a, as distinguished from being directed or bounced downwardly out of the capture and entrainment chamber C and into the room. The section comprising portions 49 and 51 cooperates with the remaining portions of the vortex liner in preventing such bouncing even though the velocity of the inlet air passing into the chamber from the generally horizontal throat portion 12 may be very high.

It is pointed out that the air in the upper vortex 16 which passes above the sixth portion 51 of the vortex liner is only slightly inclined relative to the air curtain 13, being generally parallel thereto. It is also pointed out that the sixth portion 51, which is substantially horizontal, converges relative to the lip 19 at the rear edge of baffle plate 18. There is thus being formed a generally vertical nozzle opening 53 at the rear edge of the generally horizontal throat 12, such nozzle opening 53 being generally between rear edge 52 and the rear edge 54 of lip 19. The opposed edges 52 and 54, and the nozzle opening 53 therebetween, and the inclined lip 19, cooperate with baffle plate 18 and other elements in insuring that the air entering the chamber C as the air curtain 13, and also the air in the upper vortex 16, do not bounce out of the chamber C but instead remain in the desired paths as indicated by the arrows in FIG. 1.

The nozzle is formed by the relatively long and inwardly tapering walls 51 and 18. These walls not only cause an increase in velocity of air entering chamber C from the throat portion 12, but direct, constrict and shape the flow of this air to enhance the vortex.

The radius of curvature of first portion 32 of the vortex liner 31 is relatively large, for example about 15 inches in a typical installation. The radius of curvature of the third portion 42 is even larger, for example about 18 inches in a typical installation. The radius of curvature of the generally vertical fourth portion 47 of the vortex liner is much smaller, such as about 7½ inches, whereas the radius of curvature of the fifth portion 49 is the smallest, namely about 3 inches in a typical installation. In such typical installation, the portion 51 extends about 8 inches rearwardly from the generally vertical fourth portion 47.

It is to be noted that the vortex liner 31 not only defines the upper vortex 16 in chamber C, but that the right hand portion (relative to FIG. 1) of the vortex liner defines the rear wall of the supply chamber 11. Furthermore, the fourth portion 47 of the vortex liner 31 forms the rear wall of a vertical throat portion 56 defined between the vortex liner and the front wall 45 of the apparatus. The smoothly curving rear walls of supply chamber 11 and of vertical throat portion 56, which are thus formed by the vortex liner 31, aid in the supply of a smooth flow of air from the duct means 10 to the horizontal throat portion 12.

Figure 2:
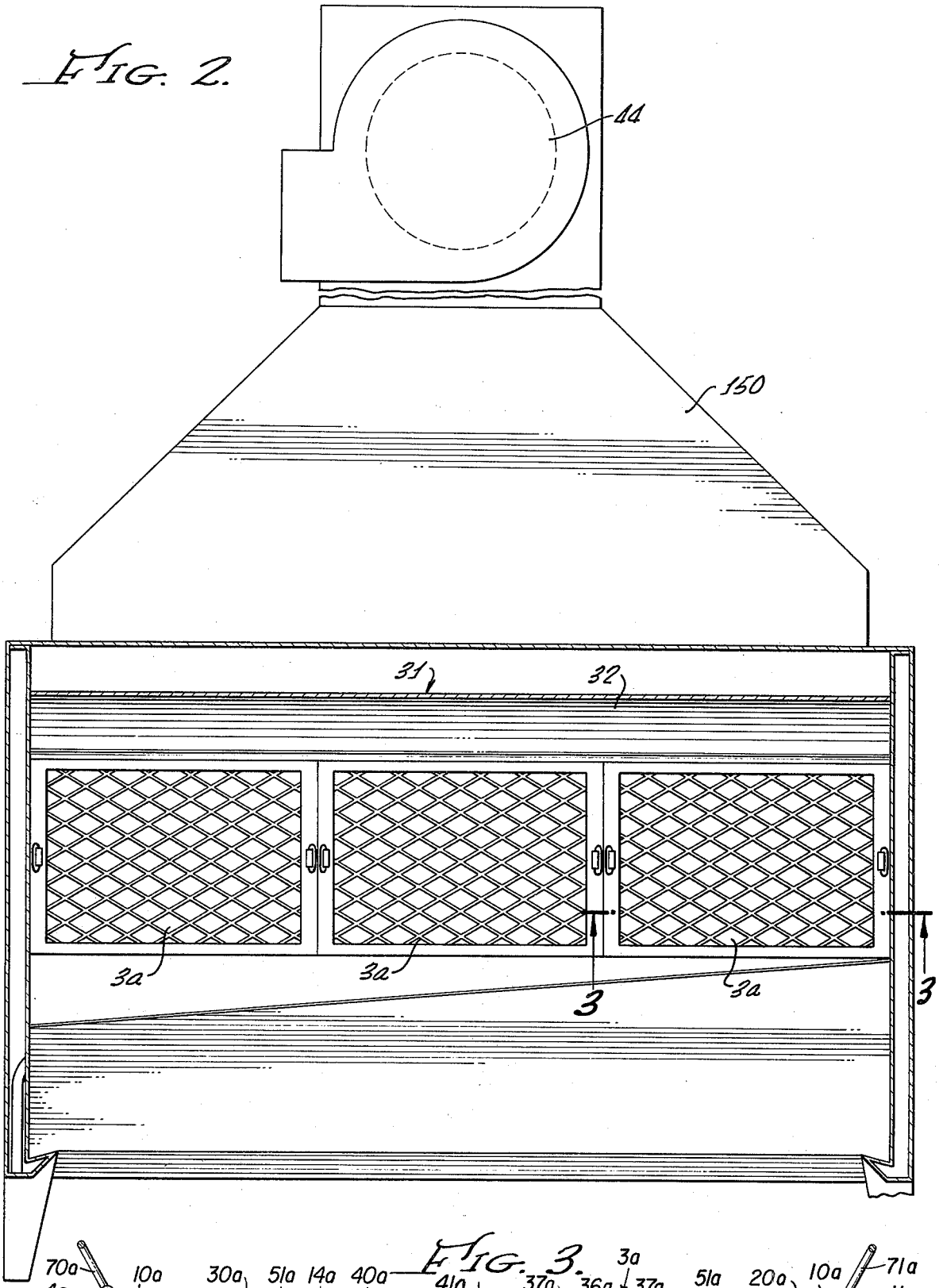
FIG. 2 is a vertical sectional view taken on line 2-2 of FIG. 1, and looking rearwardly, such FIG. 2 also illustrating the extended plenum and the exhaust blower.

As best shown in FIGS. 1 and 2, the rear edge 52 at the lower region of the vortex liner is return bent so that it will be smooth and relatively strong. Furthermore, the lower edge 33 at the rear region of the vortex liner is bent upwardly to form a flange 57. Such flange 57 preferably bends around the sheet metal element which forms the upper support for the filter means *3a.*

EMBODIMENT OF FIG. 6

Figure 6:
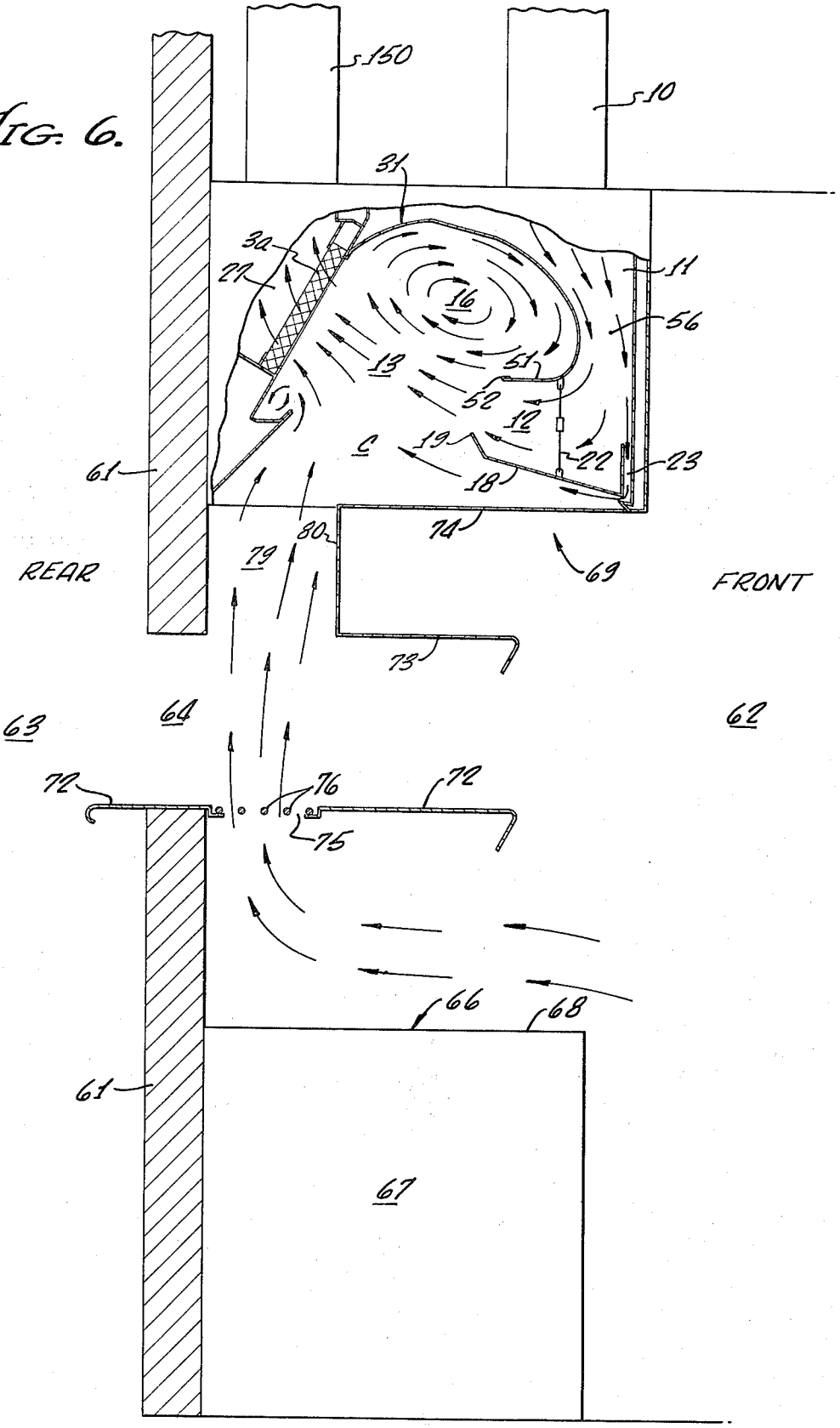
FIG. 6 is a partially schematic view illustrating a second embodiment of the invention, wherein wall means are interposed between the forward region of the cooking appliance and the forward region of the smoke hood.

Except as specifically stated below, the smoke hood shown at the upper region of FIG. 6 is identical to that described heretofore in this specification.

The smoke hood is shown as being mounted adjacent a vertical wall 61 which separates the kitchen 62 from, for example, the dining rooom 63 of a restaurant. In the illustrated embodiment, there is a pass-through opening 64 in such vertical wall 61, through which cooked food is passed by the chefs to waitresses in the dining room 63. The pass-through opening 64 is disposed a substantial distance above the upper surface 66 of a stove or other cooking appliance 67.

In accordance with the illustrated embodiment, wall means are interposed between the forward region 68 of the upper surface 66 and the forward region 69 of the smoke hood thereabove. In the illustrated embodiment there are three such wall means, one being a horizontal shelf 72 which is suitably mounted in horizontal relationship and generally level with the lower region of pass-through opening 64, the second being a horizontal plate shelf 73 which is also suitably mounted in horizontal position but level with the upper region of pass-through 64, and the third being a wall 74 which is mounted below the forward portion of the capture and entrainment chamber C.

The shelf 72 extends entirely through the pass-through opening 64, but an intermediate portion 75 of shelf 72 is open and provided with a perforated element or grill 76 through which fumes may pass upwardly from the stove 67 to the smoke hood. Thus, the chef may store food, etc., on the front (right in FIG. 6) portion of the shelf 72, and then, when desired, slide the food over the grill 76 and through the pass-through opening 64 to the rear region of shelf 72, where it is easily and conveniently picked up by the waitresses.

The plate shelf 73 is a storage area for clean plates which are maintained relatively warm due to the proximity of a chimney 79 which is defined above the grill 76 of the shelf 72 and to the rear of the plate shelf 73. Stated more specifically, the upper region of the chimney 79 is defined between the wall 61 of the room and a vertical wall 80 which extends upwardly from the rear edge of plate shelf 73 to the rear edge of wall 74.

In the operation of the embodiment of FIG. 6, the front (right in FIG. 6) region of shelf 72 acts somewhat in the nature of the upper portion of a fireplace in a household living room. Thus, air from the kitchen 62 tends to be drawn inwardly from the kitchen (away from the cook) into the space between stove surface 66 and the front region of the shelf 72, due to the heat generated by the stove 67 (which acts something in the nature of a household fireplace). This convective air flow path curves upwardly relatively adjacent vertical wall 61 and passes through the grill 76 to the chimney 79 and thence into the open-bottomed capture and entrainment chamber C. In passing over the upper surface 66 of the stove 67, the convectively flowing air picks up the grease-laden cooking fumes and carries them upwardly therewith into such chamber C, so that the fumes are separated and filtered and exhausted as described in detail previously in this specification.

Although the embodiment illustrated in FIG. 6 incorporates the pass-through opening 64 and the associated shelf 72 and grilled opening 75, these may be omitted in some restaurants. The vertical wall 62 would then be continuous and void of an opening, and the shelf 72 and the grill 76 would then be omitted. Air would then convect upwardly from the stove 67 and would tend to be relatively adjacent the vertical wall 61. It would pass upwardly through the chimney 79 to the chamber C.

The wall 74 preferably comprises a panel or sections of panels which may be removed for gaining access to the filters 3*a*. With the wall 74 removed, the filters 3*a* may be easily withdrawn through the resulting opening so they may be cleaned.

The foregoing detailed description is to be clearly understood as given by way of illustration and example only, the spirit and scope of this invention bein limited solely by the appended claims.

I claim:

1. Apparatus for filtering fumes in the space above a cooking appliance in a room which comprises:

a. wall means to define a capture and entrainment chamber adapted to be disposed above a cooking appliance in a room and to receive grease-laden fumes from said cooking appliance, b. grease filter means exposed to said chamber, c. blower means to supply air at high velocity directly to said chamber and to draw air and fumes from the side of said filter means remote from said chamber, said blower means being connected to effect said supply of air without depleting from said room more than a minor fraction of the air passed through said chamber, d. means to direct air from said blower means through said chamber in a high-velocity curtain flowing toward said filter means, whereby grease-laden fumes from said cooking appliance are entrained in said curtain and directed toward said filter means, and e. means to cause a large portion of the air and fumes from said curtain to flow in a large-diameter high-velocity vortex located above said curtain, said last-named means comprising a curved wall shaped to enhance said vortex and to minimize the tendency of air and fumes to bounce or rebound downwardly out of said chamber and into said room.

2. The invention as claimed in claim 1, in which said filter means is adapted to collect grease particles impinged directly thereagainst from said chamber, and is also shaped to effect a rapid reversal of the flow direction of air and fumes passing therethrough whereby a centrifugal grease-separation action is effected within said filter means.

3. The invention as claimed in claim 1, in which said director means recited in clause (d) is disposed below said curved wall, and in which said curved wall substantially continuously curves starting from a region above said filter means, thence upwardly and away from said filter means, and thence downwardly toward said director means.

4. The invention as claimed in claim 3, in which said curved wall has an extension at the lower portion thereof above said director means, said extension being so shaped and located that air and fumes in said vortex are directed generally parallel to and adjacent the air and fumes in the upper part of said curtain, whereby air and fumes from said vortex flow generally toward said filter means and do not bounce out of said chamber and into said room.

5. The invention as claimed in claim 4, in which said extension extends toward said filter means for a major distance from the downwardly curved portion of said curved wall.

6. A vortex-type grease hood for removing grease from the fumes generated by a cooking appliance, which comprises:

a. wall means to define a capture and entrainment chamber having opening means to admit therein the grease-laden cooking fumes from a cooking appliance, b. grease filter means having one side exposed to said chamber, c. means to define an exhaust plenum on the side of said filter means remote from said chamber, d. blower means to draw air and fumes from said exhaust plenum, and also to supply air to said chamber at relatively high velocity, e. director means to cause the air thus applied to said chamber to pass therethrough in a curtain toward said filter means for impingement thereagainst, said curtain entraining therein said grease-laden cooking fumes from said cooking appliance, said curtain and said filter means being so related to each other that a large part of the air and fumes in said curtain do not pass immediately through said filter means to said exhaust plenum but instead swerve away from said curtain in a large-diameter high-velocity vortex, and f. liner means to guide and enhance said vortex and cause air and fumes therefrom to pass through said filter means to said exhaust plenum, said liner means having one region relatively adjacent said filter means and another region relatively adjacent said director means, said liner means being curved between said one region and said other region in order to permit the air velocity in said vortex to be high, and in order to tend to prevent bouncing of air and fumes out of said chamber into the room in which said cooking appliance is disposed.

7. The invention as claimed in claim 6, in which said liner means has a relatively sharply curved portion adjacent said director means, and has relatively gradually curved portions remote from said director means.

8. The invention as claimed in claim 6, in which said liner means has one gradually curved portion adjacent said filter means and which curves upwardly and away from said filter means, and has another gradually curved portion which is connected to said one gradually curved portion and which curves downwardly and away from said filter means.

9. The invention as claimed in claim 6, in which said liner means has an extension connected to said other region and extending generally toward said filter means, said extension also being a part of said director means recited in clause (e).

10. The invention as claimed in claim 9, in which said director means further comprises an upwardly-inclined baffle disposed beneath said liner extension and spaced therefrom whereby air from said blower means passes between said baffle and said liner extension and thence toward said filter means.

11. The invention as claimed in claim 10, in which said baffle has an upwardly bent lip portion at the edge thereof relatively adjacent said filter means.

12. The invention as claimed in claim 6, in which said opening means recited in clause (a) is directly open to said room.

13. The invention as claimed in claim 6, in which said opening means recited in clause (a) communicates with said room through a chimney means, said chimney means being adapted to extend downwardly toward the cooking appliance with which said grease hood is associated.

14. The invention as claimed in claim 6, in which said liner means has a first portion relatively adjacent said filter means and which curves upwardly and forwardly from the vicinity of the upper edge of said filter means, a second portion which extends downwardly and forwardly from said first portion, a third portion which curves downwardly and forwardly from said second portion, a fourth portion which curves downwardly from said third portion, and a fifth portion which curves downwardly and rearwardly from said fourth portion.

15. The invention as claimed in claim 14, in which the curvature of said first portion is relatively gradual, that of said third portion is more gradual than that of said first portion, that of said fourth portion is less gradual than that of said third portion, and that of said fifth portion is relatively sharp.

16. The invention as claimed in claim 14, in which said second portion is substantially flat and has a light fixture mounted therein.

17. The invention as claimed in claim 14, in which a liner extension is connected to the rear region of said fifth portion, said liner extension also forming part of said director means, said liner extension extending a substantial distance toward said filter means in a direction generally parallel to said curtain.

18. The invention as claimed in claim 15, in which said liner extension is substantially flat.

19. The invention as claimed in claim 6, in which said filter means is adapted to collect grease particles impinged directly thereagainst from said chamber, and is also shaped to effect a rapid reversal of the flow direction of air and fumes passing therethrough whereby a centrifugal grease-separation action is effected within said filter means.

20. The invention as claimed in claim 6, in which said blower means communicates with said director means through a generally vertical throat region, said throat region being defined between a front wall of the grease hood and a generally vertical curved portion of said liner means.

21. The invention as claimed in claim 20, in which a liner extension is connected to said liner means adjacent said director means, said liner extension also forming part of said director means, said liner extension extending toward said filter means to an edge or lip, said edge or lip being much less remote from said filter means than is said generally vertical curved portion of said liner means.

22. A grease hood system for use with a room in which a cooking appliance is disposed, which comprises:

a. wall means to define an open-bottomed capture and entrainment chamber, b. grease filters mounted along the rear side of said chamber, c. a vortex liner forming part of said wall means and having a rear region located relatively adjacent the upper edges of said filters, said vortex liner curving upwardly and forwardly from said rear region and then curving downwardly and forwardly to a forward region spaced a major distance from said rear region, d. an extension connected to said forward region of said vortex liner, said extension extending rearwardly a substantial distance, e. a baffle spaced below said extension, f. blower means, g. means to define an exhaust plenum on the side of said filters remote from said chamber, h. inlet means to conduct air to the space between said extension and said baffle for flow into said chamber, and i. means to associate said blower means, said exhaust plenum and said inlet means in such manner that air and fumes are drawn through said filters from said chamber, and air is passed at high velocity to said inlet means for flow into said chamber.

23. The invention as claimed in claim 22, in which said filters are inclined forwardly from the vertical whereby the upstream faces of said filters face somewhat downwardly toward the open bottom of said chamber, and in which said forward region of said vortex liner is at a much lower elevation that that of said rear region thereof.

24. The invention as claimed in claim 22, in which said baffle inclines upwardly and rearwardly and has an upwardly-bent lip region at the rear edge thereof.

25. The invention as claimed in claim 22, in which said means recited in clause (i) effects said drawing of air and fumes from said chamber, and said passing of air at high velocity to said inlet means, without depleting fromo the room in which said cooking appliance is disposed a major percentage of the air passing through said chamber.

26. The invention as claimed in claim 25, in which said blower means comprises an exhaust blower connected to said exhaust plenum and exhausting to a region exterior to the room in which the cooking appliance associated with said grease hood is disposed, and further comprises an intake blower connected directly to said inlet means.

27. The invention as claimed in claim 22, in which said extension is at an elevation substantially the same as that of the lower regions of said filters.

28. The invention as claimed in claim 22, in which said exhaust plenum is extended for a major distance from said filters, whereby to prevent rapid increase in the velocity of air and fumes passing from said filters toward said blower means.

29. The invention as claimed in claim 22, in which said filters include components adapted to effect suden reversals of the directions of flow of air and fumes therethrough, whereby to effect a centrifugal filtering action therein.

30. The invention as claimed in claim 22, in which means are provided to cause a portion of the air and fumes passing through said chamber to form a small vortex in the region of said chamber below said filters, and in which deflector means are provided to cause the air and fumes in said small vortex to exhaust through said filters instead of passing downwardly into the room wherein the cooking appliance with which said grease hood is associated is disposed.

31. The invention as claimed in claim 22, in which chimney means are provided below said wall means and extend at least a substantial distance downwardly toward the cooking appliance with which the grease hood system is associated, whereby to enhance the upward flow into said chamber of fumes from said cooking appliance.

32. The invention as claimed in claim 22, in which said vortex liner has a generally vertical portion located above said extension, and in which said extension extends rearwardly a substantial distance from said generally vertical portion.

33. The invention as claimed in claim 32, in which said substantial distance is at least about eight inches.

34. The invention as claimed in claim 32, in which a tapering nozzle is defined between said extension and said baffle.

35. The invention as claimed in claim 22, in which said grease hood has a forward wall spaced forwardly from said forward region of said vortex liner, and in which said inlet means recited in clause (h) conducts air to the upper portion of said grease hood for downward flow between said vortex liner and said forward wall to the space between said extension and said baffle.

36. The invention as claimed in claim 34, in which said nozzle directs air into said chamber in a curtain and substantially directly toward said filters.

37. Apparatus for removing grease from the fumes generated by a cooking applicance, which comprises:

a. wall means to define a capture and entrainment chamber adapted to be disposed above a cooking appliance in a room and to receive grease-laden fumes from said cooking appliance, b. grease filter means for removing grease from said grease-laden fumes, said filter means being exposed to said chamber, c. blower means to supply air at high velocity to said chamber and to said filter means, and to draw air and fumes from the side of said filter means remote from said chamber, said blower means being connected to supply a major fraction of said supply of air passed through said chamber from regions exterior to said room, and d. vortex means to enhance grease separation by causing a large portion of the air and fumes flowing through said chamber to circulate in a large-diameter high-velocity vortex above said chamber, said vortex means comprising a curved wall shaped to enhance said vortex and to minimize escape of air and fumes downwardly out of said chamber and into said room.

* * * * *

UNITED STATES PATENT OFFICE

CERTIFICATE OF CORRECTION

PATENT NO. : 3,943,836

DATED : March 16, 1976

INVENTOR(S) : Irvin R. Kuechler

It is certified that error appears in the above-identified patent and that said Letters Patent are hereby corrected as shown below:

Column 5, line 23, change "linear" to --- liner ---.

Column 8, line 50 (line 15 of claim 6), change "applied" to --- supplied ---.

Column 9, line 65 (line 1 of claim 18), change "15" to --- 17 ---.

Column 10, line 65 (line 5 of claim 25), change "fromo" to --- from ---.

Column 11, line 10 (line 2 of claim 28), after "distance" insert --- away ---; line 15 (line 2 of claim 29), change "suden" to --- sudden ---.

Column 12, line 17 (line 2 of claim 37), change "applicance" to --- appliance ---.

Signed and Sealed this

Seventeenth Day of August 1976

[SEAL]

*Attest:*

RUTH C. MASON
*Attesting Officer*

C. MARSHALL DANN
*Commissioner of Patents and Trademarks*